US006214531B1

(12) United States Patent
Elst et al.

(10) Patent No.: US 6,214,531 B1
(45) **Date of Patent: *Apr. 10, 2001**

(54) LIGHT-SENSITIVE EMULSION HAVING TABULAR GRAINS RICH IN SILVER BROMIDE DOPED WITH THIOCYANATE COMPLEXES OF RHODIUM

(75) Inventors: Kathy Elst, Kessel; Dirk Vandenbroucke, Boechout; Gina De Lamper, Hoboken, all of (BE)

(73) Assignee: Agfa-Gevaert, Mortsel (BE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/233,176

(22) Filed: Jan. 19, 1999

Related U.S. Application Data

(60) Provisional application No. 60/077,359, filed on Mar. 9, 1998.

(30) Foreign Application Priority Data

Jan. 30, 1998 (EP) ..... 98200281

(51) Int. Cl.[7] ..... G03C 1/09

(52) U.S. Cl. ..... 430/567; 430/605; 430/967

(58) Field of Search ..... 430/605, 567, 430/967

(56) References Cited

U.S. PATENT DOCUMENTS

| | | | | |
|---|---|---|---|---|
| 5,567,580 | | 10/1996 | Fenton et al. | 430/567 |
| 5,595,864 | * | 1/1997 | Van Den Zegel et al. | 430/569 |
| 5,616,446 | | 4/1997 | Miura et al. | 430/219 |

FOREIGN PATENT DOCUMENTS

| | | | |
|---|---|---|---|
| 0 677 773 A1 | 10/1995 | (EP) | G03C/1/005 |

OTHER PUBLICATIONS

Dt. Chem. Ges.: "Gmelins Handbuch Der Anorganischen Chemie", Verlag Chemie, Weinheim/Bergstr., Germany (1955), vol. 64, XP002069369.

* cited by examiner

*Primary Examiner*—Mark F. Huff
(74) *Attorney, Agent, or Firm*—Breiner & Breiner

(57) ABSTRACT

A light-sensitive silver halide photographic emulsion has been described comprising a binder and tabular grains rich in silver bromide, characterized in that said grains contain as a dopant $RhCl_x(SCN)_y$, wherein each of x and y are integers having a value of at least 1 and less than 6 so that x+y equals 6.

11 Claims, No Drawings

LIGHT-SENSITIVE EMULSION HAVING TABULAR GRAINS RICH IN SILVER BROMIDE DOPED WITH THIOCYANATE COMPLEXES OF RHODIUM

DESCRIPTION

This application claims the benefit of U.S. Provisional Application No. 60/077,359, filed Mar. 9, 1998.

FIELD OF THE INVENTION

The present invention deals with a light-sensitive silver halide emulsion having tabular silver halide grains rich in silver bromide and silver halide photographic materials comprising said emulsions. A radiological method using said material particularly suitable for mammographic applications is disclosed.

BACKGROUND OF THE INVENTION

The incidence of breast cancer carcinoma among women continues to increase, posing a serious health problem throughout the world. The mortality rate from breast cancer can be decreased significantly by early detection using the radiological mammography technique. With this technique the compressed breast is irradiated with soft X-rays emitted from an X-ray generating device and the modulated X-rays are detected with a radiographic X-ray conversion screen, also called intensifying screen, fluorescent screen or phosphor screen. The X-ray conversion screen comprises a luminescent phosphor which converts the absorbed X-rays into visible light and the emitted visible light exposes a silver halide film that is brought into contact with said X-ray conversion screen. After film processing, comprising the steps of developing, fixing, rinsing and drying, a mammogram is obtained which can be read on a light box.

No other field of medical radiology demands such a high level of image quality as mammography and the ability of the mammogram to portray relevant diagnostic information is highly determined by the image quality of the screen-film system. Image quality is manifested by a number of features in the image including sharpness, noise, contrast, silver image color and skin line perceptibility. It is common practice to set the amount of X-ray exposure so that the tissues on the inside of the breast are depicted at medium optical density values, i.e. in the optical density range from Dmin+1.0 to Dmin+2.5 (Dmin being defined as the base+fog density obtained after processing the unexposed film), and the diagnostic perceptibility of small, potentially malignant lesions in these tissues is highly determined by the contrast of the mammography film within said density range. A quantitative measure of the film contrast is the so-called average gradation, defined as the slope of the line drawn by connecting both points of the sensitometric curve of optical density vs. logarithmic exposure at which the optical density is equal to Dmin+1.0 and Dmin+2.5.

Conventional mammography films can roughly be classified in low and high contrast types according to the value of their average gradation as defined above. The low contrast type can be characterized by a relatively low average gradation ranging from 2.0 to 2.5 whereas the average gradation of the high contrast type may range higher than 3.0. Often, high contrast films are preferred because of the higher ability to detect tiny cancers deep in the glandular tissue of the breast. If the contrast is too high, however, it may preclude visualisation of both thin (i.e. the skin line) and thick tissues (i.e. the inside of the breast) in the same image due to lack of exposure latitude. Therefore, some radiologists prefer low contrast mammography films. When the contrast is low, skin line perceptibility is excellent, but then the chance of missing possibly malignant breast lesions is high. Thus a balance has to be found between contrast and exposure latitude and an example of this approach has been described in U.S. Pat. No. 5,290,655.

In order to extend the exposure latitude some manufacturers have introduced high contrast mammography films characterized by a higher maximum density (hereinafter referred to as Dmax) than conventional high contrast films, e.g. a Dmax equal to at least 3.7, preferably even higher than 4.0. However, a film characterized by a higher Dmax is only a minor improvement with regard to better skin line perceptibility, since the background density is too high for the skin line to be clearly visible. Indeed at optical density values above 3.5, the local gradient, i.e. the slope of the sensitometric curve must be very high in order to guarantee a reasonable perceptibility as described in the classic article 'Determination of optimum film density range for r öntgenograms from visual effect' by H. Kanamori (Acta Radiol. Diagn. Vol.4, p. 463, 1966). Nevertheless, mammography films with a higher Dmax are appreciated by a growing number of radiologists because of the wider dynamic range, i.e. the density range Dmax–Dmin of the mammogram.

Some improvements have been obtained by modifying the X-ray generating device, such as the scanning mammography system described in U.S. Pat. No. 5,164,976. These solutions however require the replacement of the conventional X-ray apparatus by a completely new system of a much higher technical complexity. Athough it remains difficult to obtain mammograms with high contrast and high Dmax that also clearly depict thin tissue such as the skin line of the breast a suitable solution has been offered as disclosed in EP-A 0 874 275. Therein a silver halide photographic material has been disclosed, having a total silver coverage from 6.0 to 9.0 g/m$^2$ expressed as silver nitrate, wherein the emulsion layer(s) comprise(s) cubic or tabular silver halide grains and wherein the silver coverage of the tabular silver halide grains is lower than the silver coverage of the cubic silver halide grains. Said material is further characterized by a sensitometric curve of optical density as a function of relative logarithmic exposure (hereinafter referred to as logE), having an average gradation of at least 3.5 between the two points where the optical density is Dmin+1.0 and Dmin+2.5 (Dmin being defined as the optical density obtained after processing the unexposed film); a local gradient ranging from 0.7 to 1.8 and an optical density not higher than 3.5 at the point where logE equals SP+0.8 (SP being defined as the logE at which the optical density equals Dmin+1.0); and an optical density of at least 3.7 at the point where logE equals SP+1.3.

Maintaining the image quality constant is becoming another requirement of facilities performing mammography. Accordingly, quality control tests are executed on a regular basis in order to monitor the consistency of the performance of the X-ray equipment, the image receptors and the film processor. In order to minimize the influence of varying film processing time, temperature, chemistry and replenishment, a preferred mammography film requires a stable speed and contrast with regard to these processing parameters. In addition, there is a general trend in the field of radiology to shorten the film processing time and likewise in the field of mammography, being driven by intensified screening programs, the interest has focused on rapid access of mammograms.

As a consequence, mammography films are preferred which comprise silver halide crystals that can be processed rapidly and consistently in a dry-to-dry processing cycle of 90 seconds or less and therefore, most mammography films today comprise good developable cubic silver halide crystals. As described in EP-A 0 712 036 such cubic crystals show a stable speed and contrast upon varying processing parameters. Cubic emulsions however are characterized by a very high contrast, resulting in a poor skin line perceptibility.

Especially in rapid processing applications it is very difficult to obtain the desired low fog, high speed and high covering power simultaneously. Replacing cubic grain emulsions by tabular grain emulsions is in favour of getting a high covering power at moderate coating amounts of silver halide as has been demonstrated e.g. in U.S. Pat. No. 4,414,304. Disadvantages of tabular grains however are the lower cantrast than the contrast obtainable with cubic grains and residual coloration of the processed image, especially in short processing cycles, due to strong adsorption of huge amounts of spectral sensitizing dye(s) at the large specific surface area, characteristic for the said tabular grains.

Making use of a mixture of cubic and tabular grains or of a multilayer arangement of cubic and/or tabular grains as in EP-A's 0 874 275 and 0 770 909 respectively is more complex and less interesting from the point of view of reproducibility of the production process.

OBJECTS AND SUMMARY OF THE INVENTION

Therefore it is an object of the present invention to provide light-sensitive silver halide photographic materials coated with tabular grains offering high speed at moderate coating amounts, without the disadvantages of the thereby expected low contrast and wherein said tabular grains are produced in a production friendly and reproducible way.

More particularly it is an object of the present invention to provide a radiological method making use from said material in mammographic applications wherein after exposing and processing an image is formed having the desired contrast at differing densities, which is of utmost importance with respect to the high requests put on image quality, especially sharpness, in medical diagnosis.

Further objects and advantages of the present invention, which may be obtained by specific embodiments, will become apparent from the description hereinafter.

According to the present invention a light-sensitive silver halide photographic emulsion is provided comprising a binder and tabular grains rich in silver bromide, characterized in that said grains contain as a dopant $RhCl_x(SCN)_y$, wherein each of x and y are integers having a value of at least 1 and less than 6 so that x+y equals 6.

DETAILED DESCRIPTION OF THE INVENTION

According to the present invention in order to get light-sensitive silver halide photographic emulsions comprising a binder and tabular grains rich in silver bromide, wherein said grains contain as a dopant $RhCl_x(SCN)_y$, wherein each of x and y are integers having a value of at least 1 and less than 6 so that x+y equals 6, the said dopant should be prepared before addition to the reaction vessel wherein said grain are formed. Starting from an aqueous solution of $Na_3(RhCl_6).12H_2O$ the desired dopant as set forth hereinbefore was obtained by the addition of NaSCN in stoichiometric amounts in order to replace chloride ions by thiocyanate ions in order to obtain the required values of x and y for the complex ion in the dopant. It has unexpectedly been observed now that the presence in the light-sensitive silver halide photographic emulsions, more particularly in {111} tabular grains rich in silver bromide, of $RhCl_x(SCN)_y$ complexes as dopants, wherein, wherein each of x and y are integers having a value of at least 1 and less than 6 so that x+y equals 6, leads to the desired higher contrast, without a remarkable loss in speed, depending on the amounts of dopant added to the tabular grains coated in mammographic materials wherein the desired effect is obtained.

Said amounts of dopant pre sent in silver halide photographic emulsions according to the present invention are from 1 ppb up to 1 ppm versus silver, more particularly from 1 ppb up to 100 ppb and still more preferably from 5 ppb up to 75 ppb.

In mammographic applications a practical mammogram is obtained by subjecting a film-screen system to X-ray exposure. In the diagnostic image forming method according to the present invention any commercially available X-ray generating device may be used, providing an exposure to soft X-rays with a tube voltage of 20 to 40 kV. A preferred luminescent phosphor coated in the X-ray conversion screen is $Gd_2O_2S$:Tb, which emits green light in the wavelength range from 540 tot 555 nm. Said phosphor and its use in intensifying screens have been described extensively in patent literature, e.g. in U.S. Pat. Nos. 3,872,309; 4,130,429; 4,912,333; 4,925,594; 4,994,355; 5,021,327; 5,107,125 and 5,259,016 and in GB-Patent 1,489,398. Phosphor screens with emission spectra in other wavelength ranges, e.g. in the blue spectrum, may also be applicable. The thickness of the phosphor layer depends on the amount of coated phosphor required to obtain the desired screen speed. A preferred intensifying screen used in the method according to the present invention is characterized by a phosphor coating weight of at least 45 mg/cm$^2$ and a phosphor to binder ratio of at least 97:3 as described in EP-A 0 712 036.

In order to obtain a satisfactory image resolution, mammography films comprise one or more light-sensitive silver halide emulsion layer(s) on only one side of a transparent support, which is typically a blue colored polyethylene-terephtalate film having a thickness of 175 $\mu$m. Preferably one or more backing layer(s), which operate as anti-halation and anti-curl layer, are present on the opposite side of said support. One or more subbing layers may be coated directly on the support to improve the adhesion of the emulsion and backing layer(s) to the support. In addition, an undercoat layer between the emulsion and subbing layer(s) and a protective layer on top of the emulsion layer(s) may be present. Additional non light-sensitive intermediate layers are optional.

In a preferred embodiment, the light-sensitive emulsion layer(s) of the material according to the present invention comprise(s) tabular silver halide grains as will be illustrated in detail by the working examples. More preferably said tabular grains are {111} tabular silver bromo(iodide) grains as those described in U.S. Pat. No. 5,595,864. {111} tabular silver halide grains are crystals possessing two parallel (111) faces with a ratio of the diameter of a circle having the same area as these faces versus the thickness, being the distance between the two major faces, equal to at least 2. So emulsions according to the present invention have tabular grains with a {111} crystal habit with an aspect ratio of more than 2, an average equivalent crystal diameter of at least 0.5 $\mu$m, an average thickness of from 0.06 to 0.30 $\mu$m and wherein said grains account for a total projected area of at least 90% with respect to all grains present. The precipitation methods of tabular silver halide grains are also extensively described in patent literature. Preferred methods, providing relatively narrow grain size distributions with a variation coefficient of less than 0.30 are described in e.g. U.S. Pat. No. 5,290,655.

According to the present invention said silver halide emulsions have tabular grains with a hexagonal {111} crystal habit showing a percentage variation coefficient on average crystal diameter of the silver halide distribution of less than 20%.

Though the silver halide emulsions of the present invention may comprise grains having chloride in combination with bromide or bromoiodide, the preferred tabular grain emulsions comprise silver bromide or silver iodobromide grains having bromide in an amount of at least 90 mole %, having an average iodide content of at most 3 mole % and more preferably iodide in an amount of at most 1 mole %. The iodide distribution can be homogeneous over the whole crystal volume or may be present as a so-called core-shell crystal structure, i.e. a silver halide crystal having distinct phases characterized by a different iodide to bromide ratio. More than one shell can be present and between different phases it can be recommended to have a phase enriched in silver iodide by applying the so-called conversion technique during precipitation. Iodide ions can be provided by adding aqueous solutions of inorganic salts thereof as e.g. sodium, potassium or ammonium iodide or by adding organic compounds which are capable of releasing iodide ions as described in the EP-A's Nos. 0 561 415; 0 563 701; 0 563 708; 0 649 052 and 0 651 284.

According to the present invention have gelatin or colloidal silica sol as a binder.

In one embodiment the precipitation of the tabular silver halide crystals according to the present invention is indeed performed in the presence of a protective, hydrophilic colloid, e.g. conventional lime-treated or acid treated gelatin but also oxidized gelatin or a synthetic peptizer may be used. The preparation of such modified gelatin types has been described in e.g. "The Science and Technology of Gelatin", edited by A. G. Ward and A. Courts, Academic Press 1977, page 295 and next pages. The gelatin can also be an enzyme-treated gelatin as described in Bull. Soc. Sci. Phot. Japan, No. 16, page 30 (1966). Before and during the formation of the silver halide grains it is common practice to establish a gelatin concentration of from about 0.05% to 5.0% by weight in the dispersion medium.

In another embodiment tabular silver halide grains used in emulsions according to the present invention are precipitated in the absence of gelatin by using colloidal silica sol as a protective colloid in the presence of an onium compound, preferably a phosphonium compound, as has been described in EP-A 0 677 773.

In order to control the grain size, grain growth restrainers or accelerators may be used during the precipitation or the flow rate or concentration of the silver and halide salt solutions, the temperature, pAg, physical ripening time, etc. may be varied. Silver halide solvents such as ammonia, a thioether compound, thiazolidine-2-thione, tetra-substituted thiourea, potassium or ammonium rhodanide and an amine compound may be present during grain precipitation in order to adjust the average grain size.

At the end of the precipitation the emulsion is made free from excess of soluble inorganic salts by a conventional washing technique e.g. flocculation by ammonium sulphate or polystyrene sulphonate, followed by one or more washing and redispersion steps. Another well-known washing technique is ultrafiltration. Finally, extra gelatin can be added to the emulsion in order to obtain a gelatin to silver ratio which is optimized with respect to the coating conditions and/or to establish the required thickness of the coated emulsion layer. Preferably a gelatin to silver halide weight ratio ranging from 0.3 to 1.0 is then obtained.

The silver halide emulsions may be chemically sensitized according to the procedures described in e.g. "Chimie et Physique Photographique" by P. Glafkides, in "Photographic Emulsion Chemistry" by G. F. Duffin, in "Making and Coating Photographic Emulsion" by V. L. Zelikman et al, and in "Die Grundlagen der Photographischen Prozesse mit Silberhalogeniden" edited by H. Frieser and published by Akademische Verlagsgesellschaft (1968). As described in the above mentioned literature, chemical sensitization can be carried out by effecting the ripening in the presence of small amounts of compounds containing sulphur, selenium or tellurium e.g. thiosulphate, thiocyanate, thiourea, selenosulphate, selenocyanate, selenoureas, tellurosulphate, tellurocyanate, sulphites, mercapto compounds, and rhodamines. In a preferred embodiment, these compounds are applied in combination with a noble metal salt, preferably a gold complex salt, but also salts of platinum, palladium and iridium as described in U.S. Pat. No. 2,448,060 and GB-Patent No. 618,061 may be used. The amount of gold, used in the chemical ripening of emulsions according to the present invention, is preferably in the range of 25 to 45 ppm vs. the amount of metallic silver. Additions of sulphur and/or selenium and/or tellurium and gold may be carried out consecutively or simultaneously. In the latter case the addition of goldthiosulphate, goldselenosulphate or goldtellurosulphate compounds may be recommended. Optionally, small amounts of compounds of Rh, Ru, Pb, Cd, Hg, or Tl can be added.

Also reductors may be added as chemical sensitizers e.g. tin compounds as described in GB-Patent No. 789,823, amines, hydrazine derivatives, formamidine-sulphinic acids, and silane compounds. The chemical sensitization can also proceed in the presence of phenidone and/or its derivatives, a dihydroxybenzene as hydroquinone, resorcinol, catechol and/or a derivative(s) thereof, one or more stabilizer(s) or antifoggant(s), one or more spectral sensitizers or combinations of said ingredients.

The silver halide grains present in a mammography film as in the present application are spectrally sensitized in order to optimally detect the light emitted from the X-ray conversion screen. So a preferred mammography film is characterized by a spectral sensitivity ranging from 5 to 80 microjoules per $m^2$ measured at the emission maximum of the X-ray conversion screen, said spectral sensitivity being defined herein as the amount of exposure to light of a given wavelength required to obtain an optical density Dmin+1.0 after processing.

The silver halide emulsion can be spectrally sensitized by adding one or several cyanine dyes, merocyanine dyes, complex cyanine dyes, complex merocyanine dyes, hemicyanine dyes, styryl dyes and hemioxonol dyes. Preferred examples of suitable orthochromatic spectral sensitizers are 5,5'-dichloro-3,3'-bis($SO_3$-R)-9-ethylbenzoxacarbocyanines with R being n-propylene or n-butylene. Furthermore, green-light absorbing spectral sensitizers according to the formulae given in JP-A's 06,035,104; 06,035,101; 06,035,102; 62,191,847; 63,249,839; 01,312,536; 03,200,246; U.S. Pat. No. 4,777,125 and DE 3,819,241 may be used. The right choice of said sensitizers or combinations thereof is always related to the purpose of obtaining the highest possible photographic speed while reducing dye stain after processing. Another survey of useful chemical classes of spectral sensitizers is described by F. M. Hamer in "The Cyanine Dyes and Related Compounds", 1964, John Wiley & Sons and other examples specifically useful for spectral sensitization of tabular grains are given in Research Disclosure Item 22534. In addition, a more recent overview is given in EP-A 0 757 285, filed Aug. 1, 1995.

Traditionally spectral sensitization follows the completion of chemical sensitization. However, the spectral sensitisation of tabular grains in particular may occur simultaneously with or even precede completely the chemical sensitization step: it is generally recognized that spectral sensitizers may act as site-directors during the formation of sensitivity specks by the chemical sensitization of tabular grains, thereby enhancing their photographic properties.

Other dyes, which per se do not have any spectral sensitization activity, or certain other compounds, which do not substantially absorb visible radiation, can have a supersensitization effect when they are incorporated together with said spectral sensitizing agents into the emulsion. Suitable supersensitizers are, i.a. heterocyclic mercapto compounds containing at least one electronegative substituent as described e.g. in U.S. Pat. No. 3,457,078, nitrogen-containing heterocyclic ring-substituted aminostilbene compounds as described e.g. in U.S. Pat. Nos. 2,933,390 and 3,635,721, aromatic organic acid/formaldehyde condensation products as described e.g. in U.S. Pat. No. 3,743,510 as well as cadmium salts and azaindene compounds.

At least one non-spectrally sensitizing dye can be added to an emulsion layer or to one or more non-light-sensitive hydrophilic layers such as the backing layer(s). The presence of such dye(s) in adapted amounts is not only recommended to adjust the sensitivity of the different emulsion layers and eventually the required contrast, but also in order to reduce scattering of exposure radiation and thus to enhance sharpness. Preferred dyes are those that are removed easily from the photographic material during wet processing in order not to leave any residual color. When said dyes are added to the emulsion side, it may be preferred that these dyes are non-diffusible during coating of the hydrophilic layers. Examples of such dyes, without being limited thereto, are the dyes that have been described in e.g. U.S. Pat. Nos. 3,560,214; 3,647,460; 4,288,534; 4,311,787 and 4,857,446. These dyes may be added to the coating solution as a solid particle dispersions of water insoluble dyes having a mean particle diameter of less than 10 $\mu$m, more preferably less than 1 $\mu$m and still more preferably less than 0.1 $\mu$m. Examples of such dyes are disclosed in EP-A's. 0 384 633; 0 351 593; 0 586 748; 0 587 230 and 0 656 401, EP-A's. 0 323 729; 0 274 723 and 0 276 566, and in U.S. Pat. Nos. 4,900,653; 4,904,565; 4,949,654; 4,940,654; 4,948,717; 4,988,611; 4,803,150 and 5,344,749. Said dyes can also be added in the form of a solid silica particle dispersion as has been disclosed in EP-A 0 569 074. Still another technique applied in order to obtain ultra fine dye dispersions consists in acidifying a slightly alkaline coating composition "in situ" just before coating it onto the supporting layer. A more recent review of dispersion methods has been described in EP-A 0 756 201.

The silver halide emulsions according to the present invention may also comprise compounds preventing the formation of a high minimum density or stabilizing the photographic properties during the production or storage of photographic materials or during the photographic treatment thereof. Many known compounds can be added as fog-inhibiting agent or stabilizer to the silver halide emulsion. Suitable examples are i.a. the heterocyclic nitrogen-containing compounds such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methylbenzotriazole), nitrobenzotriazoles, mercaptotetrazoles, in particular 1-phenyl-5-mercapto-tetrazole, mercaptopyrimidines, mercaptotriazines, benzothiazoline-2-thione, oxazoline-thione, triazaindenes, tetrazaindenes and pentazaindenes, especially those described by Birr in Z. Wiss. Phot. 47 (1952), pages 2–58, triazolopyrimidines such as those described in GB-A 1,203,757, GB-A 1,209,146, JP-B 77/031738 and GB-A 1,500,278, and 7-hydroxy-s-triazolo-[1,5-a]-pyrimidines as described in U.S. Pat. No. 4,727,017, and other compounds such as benzenethiosulphonic acid, benzenethiosulphinic acid and benzenethiosulphonic acid amide. Other compounds which can be used as fog-inhibiting compounds are those described in Research Disclosure No. 17643 (1978), Chaptre VI. These fog-inhibiting agents or stabilizers can be added to the silver halide emulsion prior to, during, or after the ripening thereof and mixtures of two or more of these compounds can be used.

The binder of the layers, especially when gelatin is used as a binder, can be forehardened with appropriate hardening agents such as those of the epoxide type, those of the ethylenimine type, those of the vinylsulfone type, e.g. 1,3-vinylsulphonyl-2-propanol or di-(vinylsulphonyl)-methane, vinylsulphonyl-ether compounds, vinylsulphonyl compounds having soluble groups, chromium salts like e.g. chromium acetate and chromium alum, aldehydes as e.g. formaldehyde, glyoxal, and glutaraldehyde, N-methylol compounds as e.g. dimethylolurea and methyloldimethylhydantoin, dioxan derivatives e.g. 2,3-dihydroxy-dioxan, active vinyl compounds e.g. 1,3,5-triacryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binder can also be hardened with fast-reacting hardeners such as carbamoylpyridinium salts as disclosed in U.S. Pat. No. 4,063,952 and with the onium compounds as disclosed in EP-A 0 408 143.

The photographic material according to the present invention may further comprise various kinds of surface-active agents in the light-sensitive emulsion layer(s) or in at least one other hydrophilic colloid layer. Suitable surface-active agents include non-ionic agents such as saponins, alkylene oxides, e.g., polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, silicone-polyethylene oxide adducts, glycidol derivatives, fatty acid esters of polyhydric alcohols and alkyl esters of saccharides, anionic agents comprising an acid group such as a carboxyl, sulpho, phospho, sulphuric or phosphoric ester group; ampholytic agents such as aminoacids, aminoalkyl sulphonic acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts. Such surface-active agents can be used for various purposes, e.g. as coating aids, as compounds preventing electric charges, as compounds improving film transport in automatic film handling equipment, as compounds facilitating dispersive emulsification, as compounds preventing or reducing adhesion, and as compounds improving photographic properties such as higher contrast, sensitization and development acceleration.

Especially when rapid processing conditions are important, development acceleration may be useful, which can be accomplished with the aid of various compounds, preferably polyoxyalkylene derivatives having a molecular weight of at least 400 such as those described in e.g. U.S. Pat Nos. 3,038,805; 4,038,075 and 4,292,400. Especially preferred developing accelerators are recurrent thioether groups containing polyoxyethylenes as described in DE 2,360,878, EP-A's 0 634 688 and 0 674 215. The same or different or a mixture of different developing accelerators may be added to at least one of the hydrophilic layers at the emulsion side. It may be advantageous to partially substitute the hydrophilic colloid binder, preferably gelatin, of the light-sensitive silver halide emulsion layer or of an hydrophilic colloid layer in water-permeable relationship therewith by suitable amounts of dextran or dextran derivatives to improve the covering power of the silver image formed and to provide a higher resistance to abrasion in wet condition.

The photographic material of the present invention may further comprise various other additives such as compounds improving the dimensional stability of the photographic material, UV-absorbers, spacing agents, lubricants, plasticizers, antistatic agents, etc. Suitable additives for improving the dimensional stability are i.a. dispersions of a water-soluble or hardly soluble synthetic polymer e.g. polymers of alkyl (meth)acrylates, alkoxy(meth)acrylates, glycidyl (meth)acrylates, (meth)acrylamides, vinyl esters, acrylonitriles, olefins and styrenes, or copolymers of the above with acrylic acids, methacrylic acids, α-β-unsaturated dicarboxylic acids, hydroxyalkyl (meth)acrylates, sulphoalkyl (meth)acrylates, and styrene sulphonic acids.

Suitable UV-absorbers are e.g. aryl-substituted benzotriazole compounds as described in U.S. Pat. No. 3,533,794, 4-thiazolidone compounds as described in U.S. Pat. Nos. 3,314,794 and 3,352,681, benzophenone compounds as described in JP-A 2784/71, cinnamic ester compounds as described in U.S. Pat. Nos. 3,705,805 and 3,707,375, butadiene compounds as described in U.S. Pat. No. 4,045,229, and benzoxazole compounds as described in U.S. Pat. No. 3,700,455.

In general, the average particle size of spacing agents is comprised between 0.2 and 10 μm. Spacing agents can be soluble or insoluble in alkali. Alkali-insoluble spacing agents usually remain permanently in the photographic material, whereas alkali-soluble spacing agents usually are removed in an alkaline processing bath. Suitable spacing agents can be made i.a. of polymethyl methacrylate, of copolymers of acrylic acid and methyl methacrylate, and of hydroxypropylmethyl cellulose hexahydrophthalate. Other suitable spacing agents have been described in U.S. Pat. No. 4,614,708.

Compounds which can be used as a plasticizer for the hydrophilic colloid layers are acetamide or polyols such as trimethylolpropane, pentanediol, butanediol, ethylene glycol and glycerine. Further, a polymer latex is preferably incorporated into the hydrophilic colloid layer for the purpose of improving the anti-pressure properties, e.g. a homopolymer of acrylic acid alkyl ester or a copolymer thereof with acrylic acid, a copolymer of styrene and butadiene, and a homopolymer or copolymer consisting of monomers having an active methylene group.

The photographic material may comprise an antistatic layer to avoid static discharges during coating, processing and other handling of the material. Such antistatic layer may be an outermost coating like the protective layer or an afterlayer or a stratum of one or more antistatic agents or a coating applied directly to the film support or other support and overcoated with a barrier or gelatin layer. Antistatic compounds suitable for use in such layers are e.g. vanadium pentoxide sols, tin oxide sols or conductive polymers such as polyethylene oxides or a polymer latex and the like.

Preferably, the photographic materials according to the present invention are characterized by a neutral silver image tone, obtained after exposure and processing. It is well known that thin tabular emulsion grains may produce a brownish, yellow or even reddish image tone and therefore, tabular grains having an average thickness of 0.2 μm or more are preferred. On the other hand, a thickness less than 0.3 μm is also preferred since thicker grains are characterized by a lower covering power of the developed silver, requiring a large amount of silver halide to be present in the photographic material in order to obtain a satisfactory maximum density. Methods to prepare thicker tabular grains have already been described in U.S. Pat. Nos. 4,801,522; 5,028,521 and 5,013,641 and EP-A 0 569 075.

The non-neutral silver image color can be corrected by increasing the optical density in the red region of the visible spectrum by adding suitable dyes to the support or any coated layer. This non-image wise color correction method has been disclosed in references as e.g. JP-A's 03,100,645; 01,029,838; 01,312,536; 03,103,846; 03,094,249; 03,255,435; 61,285,445; EP-B 271,309 and U.S. Pat. No. 4,861,702. This method however may result in an excessive base+fog density of the photographic material and therefore, a alternative way consists in an image-wise color correction by using color-forming developers, which are blue colored in their oxidized form. Examples thereof are summarized in JP-A's 03,153,234; 03,154,043 and 03,154,046. In JP-A's 03,156,447 and 03,157,645 the adsorption of a blue colored dye as a function of exposure has further been disclosed. Another method to improve the image tone of tabular grain emulsions consists of mixing them with chloride containing cubic grains, as disclosed in EP-A 0 770 909.

In addition, the photographic material may comprise preferably in the emulsion layer(s) a compound corresponding to the following formula:

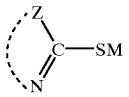

wherein Z represents a group of atoms necessary to form a 5- or 6-membered ring and M represents a hydrogen atom, an alkali metal atom or an ammonium group. The compounds of the above formula are preferably added in an amount from $10^{-6}$ to $10^{-2}$, more preferably $10^{-5}$ to $10^{-3}$ mole per mole of silver in the emulsion layer(s). Representative examples of these compounds are given in U.S. Pat. No. 5,290,655.

According to the present invention a photographic material is thus provided comprising a support and coated thereon on at least one side one or more hydrophilic light-sensitive layers, wherein at least one of said layers comprises a silver halide emulsion as disclosed hereinbefore. More preferably according to the present invention said photographic material comprises on only one side of the support only one hydrophilic light-sensitive layer comprising an emulsion as deisclosed herein, wherein light-sensitive tabular grains have a coverage of from 5.0 to 9.0 g/m$^2$, expressed as silver nitrate.

The said material is particularly suitable for use in mammographic applications.

Further, according to the present invention, with respect to mammographic applications a radiological method for obtaining a diagnostic image for mammography is offered, said method comprising the steps of (i) composing a film-screen system by bringing a photographic material as disclosed hereinbefore into contact with a radiographic X-ray conversion screen; and (ii) subjecting said film-screen system to exposure with X-rays, emitted from an X-ray generating device with a tube voltage of 20 kV to 40 kV; and (iii) processing said photographic material in a total dry-to-dry processing time of from 38 seconds up to 210 s, and more preferably in a time of from 45 s up to 90 s, by the steps of developing, fixing, rinsing or washing and drying.

The following examples illustrate the invention without however limiting it thereto.

EXAMPLES

Preparation of tabular emulsion TC1 (comparative emulsion)

To a solution of 7.5 g of an oxidized gelatin in 3 l of demineralized water, adjusted to a pBr of 2.39 by adding KBr and a pH of 1.8 by adding $H_2SO_4$, were added by a double jet method aqueous solutions of 1.96 M $AgNO_3$ (hereinafter referred to as S1) and 1.96 M KBr (hereinafter referred to as S2): 7.35 ml of S1 and 7.35 ml of S2 were added in a time interval of 9 seconds. During this period, the reaction mixture was maintained at 45° C. When the addition was completed, stirring continued during 2 minutes and then, temperature was increased up to 70° C. over a period of 25 minutes, followed by the addition, after another time of 2 minutes, of 500 ml of an aqueous gelatinous solution of 10 wt % of gelatin. After another time interval 2 minutes after said addition a NaOH solution was added over a time period of one minute in order to adjust pH to 6.0. Then stirring continued for 6 minutes at a temperature held constant at 70° C. and S2 was added by a single jet at 7.5 ml/min over a period of 5.5 minutes. Then S1, at a constant flow rate of 7.5 ml/min, and S2 at a flow rate, controlled in order to maintain pAg at 8.85, were added in a double jet over a period of 1 minute. This double jet was continued during another period of 33 minutes and 22 seconds, while the flow rate of S1 was linearly increased up to 23.1 ml/min and pAg was maintained at 8.85. This period was called "first growth step". 5 minutes after the completion of said double jet addition, S1 was added at 7.5 ml/min during 7 minutes and 30 seconds. Then another double jet started of S1 at 7.5 ml/min during 1 minute and an aqueous solution of 1.93 M KBr and 0.03 M KI (solution S3) at a controlled flow rate to maintain pAg at 7.38. This double jet was continued during another period of 41 minutes and 2 seconds, while the flow rate of S1 was linearly increased from said 7.5 ml/min up to 36.9 ml/min and pAg was maintained at 7.4. The average grain size of the silver bromoioide tabular {111} emulsion grains thus prepared, expressed as equivalent volume diameter, was 0.70 $\mu$m, the average thickness was 0.21 $\mu$m and the variation coefficient was 0.25. The iodide content was 1 mol %.

After washing, gelatine and water were added in order to obtain a silver halide content of 245 g/kg, expressed as $AgNO_3$, and a gelatin content of 83 g/kg. To 2 kg of this emulsion, of which pH was adjusted to 5.5, were added consecutively 4 ml of a 10 wt. % KSCN solution, 0.2 ml of a $4.76\times10^{-3}$ M solution of sodium toluenethiosulphonate in methanol, 780 ml of a 0.25 wt. % solution of anhydro-5,5'-dichloro-3,3'-bis(n-butyl-4-sulphonate)-9-ethyl-benzoxacarbocyanine triethylammonium salt, 9 mg sodium thiosulphate, 5.3 ml of a solution containing $1.46\times10^{-3}$ M chloro auric acid and $1.58\times10^{-2}$ M ammonium rhodanide, and finally 10 ml of a 1 wt. % solution of 1-(p-carboxyphenyl)-5-mercapto-tetrazole and this mixture was chemically ripened during 4 hours at 48° C. After cooling, a preservative was added.

Preparation of tabular emulsion TC2

Same emulsion as TC1, except for the addition in the chemical ripening of 7 mg of sodium thiosulphate and of 20 ml of a solution containing $1.46\times10^{-3}$ M chloro auric acid.

Preparation of tabular emulsion TC3

Same emulsion as TC1, except for the addition of 50 ppb of $RhCl_6$ (as $Na_3(RhCl_6).12H_2O$, present in an aqueous solution $1.47\times10^{-5}$ M) after 22 min. and 24 s, i.a. after starting the "first growth step" (referred to in the preparation of TC1), within a time interval of 4 minutes. Crystals were morphologically the same as those in TC1 and the same chemical ripening was applied as for TC1.

Preparation of tabular emulsion TC4

Same emulsion as TC3, but the same chemical ripening was applied as for TC2.

Preparation of tabular emulsion TI1 (inventive emulsion)

Same emulsion as TC1, except for the addition of 5 ppb of $Na_3(RhCl_xSCN_y).12H_2O$ (from an aqueous solution $1.47\times10^{-5}$ M) after 22 min. and 24 s, i.a. after starting the "first growth step" (referred to in the preparation of TC1), within a time interval of 4 minutes. Crystals were morphologically the same as those in TC1 and the same chemical ripening was applied as for TC1.

Preparation of tabular emulsion TI2 (inventive emulsion)

Same emulsion as TI1, except for application of the same chemical ripening as was applied for TC2.

Preparation of tabular emulsion TI3 (inventive emulsion)

Same emulsion as TI1, except for the addition of 50 ppb of $Na_3(RhCl_xSCN_y).12H_2O$ (from an aqueous solution $1.47\times10^{-4}$ M) after 22 min. and 24 s, i.a. after starting the "first growth step" (referred to in the preparation of TC1), within a time interval of 4 minutes. Crystals were morphologically the same as those in TC1 and the same chemical ripening was applied as for TC1.

Preparation of tabular emulsion TI4 (inventive emulsion)

Same emulsion as TI3, except for application of the same chemical ripening as was applied for TC2.

Preparation of tabular emulsion TI5 (inventive emulsion)

Same emulsion as TI3 but addition of 100 ppb of dopant instead of 50 ppb, with application of the same chemical ripening as was applied for TC2.

Following coating agents, summarized in Table 1, were added to the emulsion before coating the emulsion layer:

TABLE 1

| Compound (amounts per mole silver halide) | Emulsion layer |
|---|---|
| 5,5'-dichloro-3,3'-bis (n-butyl-4-sulphonate)-9-ethylbenzoxacarbocyanine, anhydrous triethylammonium salt | 50 mg |
| 4-hydroxy-6-methyl-1,3,3a,7-tetraazaindene | 87 mg |
| bis-metasulphophenyl-disulphide | — |
| 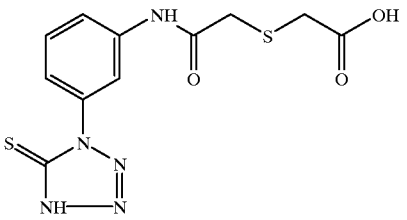 | 33 mg |
| sorbitol | 15.5 g |
| polyethylacrylate, latex plasticizer | 12 g |
| phloroglucinol | 195 mg |
| resorcinol | 2.8 g |
| potassium bromide | 160 mg |
| polydextran (M.W. 10,000) | 15 g |

Following coating agents, summarized in Table 2, were added to the protective coating before coating the protective antistress layer:

| Compound | amounts per $m^2$ |
|---|---|
| gelatin | 1.1 g |
| polymethylmethacrylate spacing agent (average particle diameter 3 mm) | 15 mg |
| chromium acetate | 5.5 mg |
| 4-hydroxy-6-methyl-1,3,3a,7-tetraazaindene | 82 mg |
| bis-metasulphophenyl-disulphide | 4 mg |
| $CF_3$—$(CF_2)_6$—COOH.NH3 | 7.5 mg |
| $CF_3$—$(CF_2)_6$—CONH—$(CH_2CH_2O)_{17-20}$—H | 19 mg |
| phenol | 150 mg |
| 1-phenyl-4-methyl-3-pyrazolidone | 0.13 mg |
| Mobilcer Q (a paraffin wax, trade name product from MOBIL OIL) | 25 ml |
| polythioether A[(a)] | 5 mg |
| formaldehyde (added just before coating) | 100 mg |

[(a)]Polythioether A is a modified poly-epichloorhydrine having an average chain length of approximately 20 monomer units and of which about 50% of the chloride groups have been replaced by a —S—$CH_2$CHOH—$CH_2$OH substituent.

(a) Polythioether A is a modified poly-epichloorhydrine having an average chain length of approximately 20 monomer units and of which about 50% of the chloride groups have been replaced by a —S—$CH_2$—CHOH—$CH_2$OH substituent.

Coating of the materials

The photographic materials according to these examples comprise one emulsion layer and one protective layer. The coating solutions of the emulsion layers were prepared by adding solutions of the compounds indicated in Table 1 to the melted emulsion while stirring. The coating solution of the protective layer is given in Table 2. After adjusting pH to 6.7, the viscosity and surface tension of the coating solutions were optimized according to the requirements of the coating method. The emulsion layer(s) and the protective layer were coated simultaneously on one side of a substrated polyester support having a thickness of 175 $\mu$m by means of conventional coating techniques. The silver coverage of the emulsions was about 7 g/$m^2$, expressed as an equivalent amount of silver nitrate.

Separate strips of the coated materials were subsequently exposed for the same exposure time of 2 seconds to white light, filtered with a U535-green light filter. Development proceeded for 12 seconds in a developer having the following composition:

| | |
|---|---|
| hydroquinone | 30 g |
| 1-phenyl-pyrazolidine-3-one | 1.5 g |
| acetic acid 99% | 9.5 ml |
| potassiumsulphite | 63.7 g |
| potassiumchloride | 0.8 g |
| EDTA-2Na | 2.1 g |
| potassium carbonate | 32 g |
| potassiummetabisulfite | 9 g |
| potassium hydroxyde | 14 g |
| diethyleneglycol | 25 ml |
| 6-methylbenztriazol | 0.09 g |
| glutardialdehyde 50 wt % | 9.5 ml |
| 5-nitroindazole | 0.25 g |
| demineralized water to make 1 l. | |

The starter solution to be added had the following composition:

| | |
|---|---|
| acetic acid 99% | 15.5 ml |
| KBr | 16 g |
| demineralized water up to | 100 ml |

Hereupon, the developed photographic strips were fixed in a conventional fixing bath comprising e.g. sodium thiosulfate and potassium metabisulfite, and then rinsed in water and allowed to dry. Sensitometric properties of these film strips are given in Table 3. This table shows the sensitometric results in terms of fog F (fog multiplied with a factor of 1000 in Table 3)., speed S (figures multiplied with a factor of 100: the lower the figure, the more sensitive is the emulsion), "toe" contrast (gradation) TG, overall contrast GG and "shoulder" contrast or gradation SG of the photographic strips prepared and exposed as set forth above and developed in the developing bath the composition of which has been set forth above during an overall developing time of 12 seconds. The values given in Table 3 for the toe contrast TG are the gradation values measured from the sensitometric curve over a density range of 0.90 starting from a density value of 0.10 up to 1.00 above fog.

For the overall contrast GG the gradation was measured from the characteristic curve over a density range of 1.75 starting from a density value of 0.25 up to 2.00 above fog.

SG was measured in the shoulder of the sensitometric curve over a density range of 1.50 starting from a density value of 1.00 up to 2.50 above fog.

Further the density latitude (DLT) has been given: said latitude has been measured as a density difference between Dmin and Dmax.

All gradation and DLT-density values have been multiplied by a factor of 100.

TABLE 3

| Matl.No. | F | S | TG | GG | SG | DLT |
|---|---|---|---|---|---|---|
| TC1 | 28 | 114 | 190 | 270 | 310 | 430 |
| TC3 | 31 | 116 | 213 | 315 | 367 | 435 |
| TI1 | 34 | 114 | 210 | 325 | 367 | 430 |
| TI3 | 36 | 120 | 220 | 337 | 386 | 440 |
| TC2 | 24 | 135 | 189 | 303 | 380 | 430 |
| TC4 | 30 | 129 | 201 | 312 | 378 | 432 |
| TI2 | 24 | 127 | 202 | 328 | 416 | 450 |
| TI4 | 19 | 136 | 212 | 336 | 422 | 440 |
| TI5 | 19 | 247 | 214 | 358 | 483 | 380 |

As can be concluded from the Table 3 hereinafter the presence in the light-sensitive silver halide photographic emulsions, more particularly in {111} tabular grains rich in silver bromide, of $RhCl_x(SCN)_y$ complexes as dopants, wherein each of x and y are integers having a value of at least 1 and less than 6 so that x+y equals 6, leads to a higher contrast, without a remarkable loss in speed, depending on the amounts of dopant added to the tabular grains.

What is claimed is:

1. Light-sensitive silver halide photographic emulsion comprising a binder and tabular grains rich in silver bromide, said grains having bromide in an amount of at least 90 mole %, characterized in that said grains contain as a dopant $RhCl_x(SCN)_y$, wherein each of x and y are integers having a value of at least 1 and less than 6 so that x+y equals 6 and wherein the dopant is situated in an inner portion of the tabular grains after addition of 20% of a total amount of silver used.

2. Emulsion according to claim 1, wherein said binder is gelatin or colloidal silica sol.

3. Emulsion according to claim 1, wherein said grains have iodide in an amount of at most 3 mole %.

4. Emulsion according to claim 1, wherein said tabular grains have a {111} crystal habit with an aspect ratio of more than 2, an average equivalent crystal diameter of at least 0.5 μm, an average thickness of from 0.06 to 0.30 μm and wherein said grains account for a total projected area of at least 90% with respect to all grains present.

5. Emulsion according to claim 4, wherein said tabular grains have a hexagonal {111} crystal habit with a procentual variation coefficient on average crystal diameter of less than 20%.

6. Emulsion according to claim 1, wherein said dopant is present in amount of from 1 ppb up to 1 ppm versus silver.

7. Emulsion according to claim 1 wherein the dopant is situated in the inner portion of the tabular grains up to addition of 25% of the total amount of silver used.

8. Emulsion according to claim 1, wherein said grains have iodide in an amount of at most 1 mole %.

9. Photographic material comprising a support and coated thereon on at least one side one or more hydrophilic light-sensitive layers, wherein at least one of said layers comprises a light-sensitive silver halide emulsion according to claim 1.

10. Photographic material according to claim 9, comprising on only one side of the support only one hydrophilic light-sensitive layer, wherein light-sensitive tabular grains have a coverage of from 5.0 to 9.0 $g/m^2$, expressed as an equivalent amount of silver nitrate.

11. Radiological method for obtaining a diagnostic image for mammography comprising the steps of (i) composing a film-screen system by bringing a photographic material according to claim 8 into contact with a radiographic X-ray conversion screen; and (ii) subjecting said film-screen system to exposure with X-rays, emitted from an X-ray generating device with a tube voltage of 20 kV to 40 kV; and (iii) processing said photographic material in a total dry-to-dry processing time of from 38 seconds up to 150 s.

* * * * *

UNITED STATES PATENT AND TRADEMARK OFFICE

CERTIFICATE OF CORRECTION

PATENT NO. : 6,214,531 B1
DATED : April 10, 2001
INVENTOR(S) : Kathy Elst et al.

It is certified that error appears in the above-identified patent and that said Letters Patent is hereby corrected as shown below:

Column 2,
Lines 20-21, "r öntgenograms" should read -- röntgenograms --.

Column 4,
Line 13, "pre sent" should read -- present --.

Column 16, claim 11,
Line 29, "claim 8" should read -- claim 9 --.

Signed and Sealed this

Fifth Day of March, 2002

*Attest:*

*Attesting Officer*

JAMES E. ROGAN
*Director of the United States Patent and Trademark Office*